United States Patent [19]

Harnish

[11] 4,314,456

[45] Feb. 9, 1982

[54] REFRIGERANT CONDENSING SYSTEM

[75] Inventor: James R. Harnish, York, Pa.

[73] Assignee: Borg-Warner Corporation, Chicago, Ill.

[21] Appl. No.: 146,716

[22] Filed: May 5, 1980

[51] Int. Cl.[3] ..... F25D 17/00; F25B 27/02

[52] U.S. Cl. ..... 62/181; 62/183; 62/238.6

[58] Field of Search ..... 126/419, 421, 422, 362; 62/238.6, 324.5, 183, 181; 237/59, 63

[56] References Cited

U.S. PATENT DOCUMENTS

| | | | |
|---|---|---|---|
| 2,544,408 | 3/1951 | Whitney et al. | 126/362 |
| 2,660,163 | 11/1953 | Whitney et al. | 126/362 |
| 2,668,420 | 2/1954 | Hammell | 62/238.6 |
| 2,716,866 | 9/1955 | Silva | 62/238.6 |
| 3,301,002 | 1/1967 | McGrath | 62/175 |
| 3,931,806 | 1/1976 | Hayes | 126/422 |
| 4,103,509 | 8/1978 | Bottum | 62/238 |
| 4,141,222 | 2/1979 | Ritchie | 62/179 |
| 4,142,379 | 3/1979 | Kuklinski | 62/179 |
| 4,146,089 | 3/1979 | Mueller et al. | 165/145 |
| 4,148,355 | 4/1979 | Gehring | 165/39 |

OTHER PUBLICATIONS

Popular Science, vol. 216, No. 4, Times Mirror Magazines, Inc., New York, N.Y., Apr., 1980, pp. 49–50.

*Primary Examiner*—William E. Wayner
*Assistant Examiner*—Harry Tanner
*Attorney, Agent, or Firm*—Thomas B. Hunter

[57] ABSTRACT

A refrigerant condensing system for heating water includes a thermostatically-operated valve for delivering 140° F. water from a condenser to the top of a water storage tank and a by-pass valve for allowing the heated water from the condenser, which is then heated to a lower temperature, to flow directly to the bottom of the storage tank after the upper third of the tank has been filled with 140° F. water, thereby increasing the efficiency and heating capacity of the refrigeration system.

7 Claims, 1 Drawing Figure

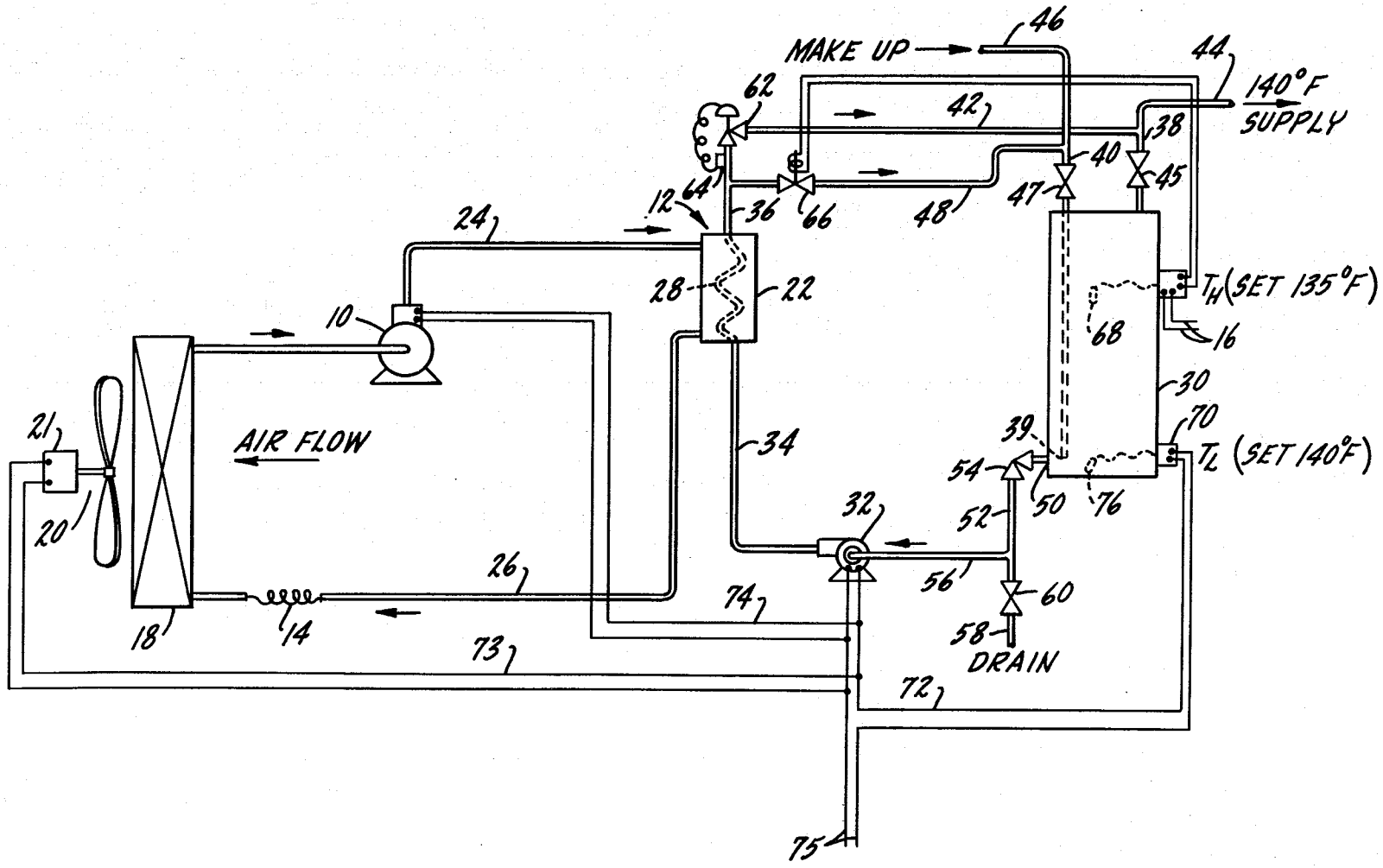
140°F SUPPLY
$T_H$ (SET 135°F)
$T_L$ (SET 140°F)
MAKE UP
DRAIN
AIR FLOW

REFRIGERANT CONDENSING SYSTEM

BACKGROUND OF THE INVENTION

1. Field of the Invention

This invention relates generally to energy conservation systems and more particularly, it relates to a refrigerant condensing system which is connected to a conventional water heater storage tank in order to heat water in the storage tank.

2. Description of the Prior Art

In U.S. Pat. No. 2,544,408 issued to L. F. Whitney et al on Mar. 6, 1951, there is disclosed a hot water system which includes a thermostatically controlled, electrically operated two-way valve. When the water temperature is above a predetermined level, it is delivered to the inlet at the top part of a storage tank, and when the water temperature is below the predetermined level, the valve is operated to pass the water through a line into the lower part of the tank.

In U.S. Pat. No. 2,660,163 issued to L. F. Whitney et al on Nov. 24, 1953, there is disclosed a hot-water generator and storage system which includes a switching valve for passing hot water from a generator to the high temperature duct of the tank and simultaneously to pass cold water from the tank through a lower temperature duct to a waste line.

In U.S. Pat. No. 3,301,002 issued to W. L. McGrath on Jan. 31, 1967, there is disclosed a reverse cycle refrigeration system which includes a second compressor and heat exchange coil interconnected therewith so as to form a second refrigeration system adapted for heating water.

In U.S. Pat. No. 4,103,509 issued to E. W. Bottum on Aug. 1, 1978, there is shown a water heater-dehumidifier combination heat pump which includes an evaporator functioning as a dehumidifier and a condenser disposed in heat exchange relationship with water in a hot water tank for heating the same.

In U.S. Pat. No. 4,141,222 issued to D. A. Richie on Feb. 27, 1979, there is shown an energy recovery system for heating water in which a temperature sensing diverting valve causes pumped water to by-pass the heat exchanger when the water temperature within the tank reaches a predetermined maximum value.

In U.S. Pat. No. 4,142,379 issued to H. W. Kuklinski on Mar. 6, 1979, there is shown an energy saving device which utilizes a pressure sensing switch for turning off the primary heater control in a storage tank whenever the air conditioning compressor is operating.

In U.S. Pat. No. 4,146,089 issued to Mueller et al on Mar. 27, 1979, there is disclosed a hot water system having a specially designed condenser from which large quantities of hot water is produced.

In U.S. Pat. No. 4,148,355 issued to K. C. Gehring on Apr. 10, 1979, there is disclosed a water heating system having a storage tank with special passageways and heat barriers for permitting the condensing refrigerant gas to come into direct contact with the side walls of the storage tank to thereby heat a relatively small volume of liquid at a relatively fast rate.

Due to the rising cost of operating electric heating elements used in connection with a hot water tank typically found in residential buildings, it has become necessary to provide a system for heating the water in the tank which will yield an increased coefficient of performance over the cost of operating the electric heating elements. While there are many known devices in the prior art which attempt to conserve energy by utilizing the air conditioning exhaust heat energy for hot water heating, none of them provide a by-pass valve for allowing the heated water from the condenser to flow to the bottom of the water tank after the upper portion of the tank has been filled with approximately 140° F. water, thereby increasing the efficiency and the heating capacity of the compression system. The present invention provides a refrigerant condensing system having such a by-pass valve which is disposed in a compact unit and located relatively close to a conventional water storage tank. Further, the compact unit is readily attachable to and easily installed to an already existing water tank. The unit is preferably enclosed within a housing containing all of the components.

SUMMARY OF THE INVENTION

Accordingly, it is a general object of the present invention to provide a new and improved refrigerant condensing system which is connected to a conventional water heater storage tank in order to heat water in the storage tank.

It is another object of the present invention to provide a refrigerant condensing system for heating water which includes a by-pass valve for allowing the heated water from the condenser to flow to the bottom of the water tank after the upper portion of the tank has been filled with approximately 140° F. water, thereby increasing the efficiency and the heating capacity of the compression system.

It is another object of the present invention to provide a refrigerant condensing system which includes a by-pass valve having a thermostatic element disposed operatively with the storage tank at a point approximately one-third from the top for sensing the water temperature therein.

It is still another object of the present invention to provide a refrigerant condensing system for heating water which can be readily connected to a conventional water heater storage tank in a relatively simple and inexpensive manner without requiring any alterations to the existing storage tank.

In accordance with these aims and objectives, there is provided in the present invention a refrigerant condensing system for heating water which includes a compressor, a condenser, a capillary tube, and an evaporator coil, all suitably interconnected to form a closed refrigerant circuit. The condenser of the system is provided with a chamber having a coil disposed therein in heat exchange relationship. A storage tank has a high temperature inlet connected to its upper part and a lower temperature inlet connected to its bottom part. A circulating pump has its inlet connected to the drain outlet of the storage tank for delivering water to be heated to the water inlet of the coil. A thermostatically-operated normally closed valve is operatively connected to the water outlet of the coil for permitting water to flow into the upper part of the tank in response to a pre-selected temperature. A by-pass valve is also operatively connected to the water outlet of the coil for by-passing directly the water flow from the high temperature inlet of the tank to the lower temperature inlet when the upper portion of the tank is filled with water of the pre-selected temperature.

DESCRIPTION OF THE DRAWING

These and other objects and advantages of the present invention will become more fully apparent from the detailed description when read in conjunction with the accompanying drawing in which there is shown a schematic circuit diagram of a refrigerant condensing system connected to a conventional water storage tank for heating the water thereof in accordance with the present invention.

DESCRIPTION OF THE PREFERRED EMBODIMENT

Referring now with particularity to the drawing, there is shown a schematic circuit diagram of a refrigerant condensing system of the present invention which includes a compressor 10, a water-cooled condenser 12, an expansion device such as a capillary tube 14 and an evaporator coil 18, all suitably interconnected to form a closed refrigeration circuit. The air to be conditioned is brought into heat exchange relationship with the evaporator coil by an evaporator fan 20 driven by an electric motor 21. The condenser 12 comprises a closed chamber 22 having its inlet connected to the compressor 12 via conduit 24 and having its outlet connected to the capillary tube 14 via conduit 26. Heat exchanger coil 28 disposed inside of the chamber 22 receives water from a water heater storage tank 30 through a circulating pump 32. The pump has its discharge side connected to the inlet of the coil 28 via conduit 34. The water is returned to the storage tank 30 after heating through return passage 36.

The storage tank 30 is provided with a high temperature inlet duct 38 connected to its upper part and a duct 40 for carrying water to a lower temperature inlet 39 connected to the bottom part of the tank. The duct 38 is connected by a tee to a hot water discharge line 42 and a hot water supply line 44. The duct 40 is connected by a tee to a cold-water make-up line 46 and a passageway 48 containing water normally heated to a lower temperature. Manually-operated shut-off valves 45 and 47 positioned at the top of the storage tank 30 are to facilitate installation and/or maintenance of the tank. The storage tank is also provided with a drain outlet 50 located at its lower part which communicates with conduit 52 via a manually-operated valve 54. The flow of water to be heated is controlled by the electrically driven circulating pump 32 whose inlet is in fluid communication with the conduit 52 via line 56. The conduit 52 is connected by a tee to a waste water line 58 by a manually-operated drain valve 60.

A thermostatically-operated normally closed valve 62 is connected by a tee to the return passage 36. This valve 62 includes a temperature-responsive element such as a bulb 64 disposed in or adjacent to the passage 36 so as to sense the temperature of the heated water. The valve 62 remains closed and prevents water to the hot water supply line 44 until the temperature of the water reaches the preselected value, which is usually about 140° F. for residential use. It should be clearly understood that the pre-selected temperature at which the valve 62 opens is adjustable and may be in the range of 120° to 140° F. or can be set at any desired temperature.

The return passage 36 is also coupled to a normally closed thermostatically-controlled solenoid actuated by-pass valve 66. The solenoid valve is electrically operated by a source connectable to conductors 16 and is associated with a thermal responsive element 68 disposed at a point substantially one-third of the way from the top and inside of the tank 30. The control of valve 66 is set or adjusted so that the valve opens to by-pass hot water flowing to the top of the tank after the upper portion, i.e., one-third, of the tank has been filled with approximately 140° F. water, to the bottom of the tank. Typically, the control of valve 66 is set to open when the water temperature rises above 135° F. A temperature sensing electric switch 70 is positioned at the bottom of the tank 30 and is in series with the lines 72, 73 and 74 supplying power from the conductors 75 to the pump 32, the electric motor 21 and the compressor 10, respectively. The switch 70 includes a thermal responsive element 76 disposed inside of the bottom of the tank which closes the contacts of the switch when the temperature of the water is sensed to be below a pre-determined temperature such as 140° F. When this event occurs, this causes energization of the pump and compressor simultaneously. The thermal responsive elements 68 and 76 may be disposed alternatively so as to contact the outside surface of the tank.

In operation, the compressor 10 receives expanded refrigerant gases from the outlet of the evaporator coil 18 and compresses these gases. The compressed hot gases from the compressor 10 is delivered to the inlet of the condenser 12. These hot gases passing through the chamber 22 condenses into liquid refrigerant by giving up heat to the water flowing in the coil 28 so that the water is heated. The liquid refrigerant is passed from the outlet of the condenser into the inlet of the evaporator coil 18 via the capillary tube 14. The liquid refrigerant flowing through the coil 18 is evaporated so as to lower the temperature of the coil. Some of the water in the air which is circulated through the evaporator coil by the fan 20 may be condensed.

Assuming that the water tank has been filled completely with cold make-up water at about 60° F. and that there is no demand for hot water in the supply line 44, the valve 62 and the by-pass valve 66 both will be closed. The switch 70 will close immediately to start the electric motor 21, the compressor 10 and the pump 32. Upon energizing of the compressor 10, hot refrigerant gas from the compressor flows into the condenser 12. Simultaneously, the energization of the pump 32 will cause cold water to be drawn from the outlet 50 of the storage tank 30 into the conduits 52,56. Also, the motor will start up the fan 20 so as to cause circulation of ambient air over the evaporator coil 18. While the valve 62 will remain closed until the water temperature in the conduit 36 rises above 140° F., which valve 62 is provided with a not-shown small internal bleeder opening for allowing small amounts of water to pass into the top of the tank via the conduits 42 and 38 so as to form a circulating path when the water is being heated from 60° F. to 140° F. Within a matter of minutes after the compressor is started, sufficiently heated water of 140° F. will be available in the conduit 36 so as to open the valve 62 thereby permitting restricted flow of hot water into the top of the tank 30 via the lines 42 and 38 and thus preventing the temperature of the water from the outlet of the coil 28 from falling below essentially 140° F.

As hot water is circulated into the tank, the water begins to stratify with hot water at the top of the tank and colder water at the bottom of the tank. As more and more water is heated in the condenser and is passed into the top of the tank, the marginal line of stratification in the tank moves progressively lower until the upper one-third of the tank is filled with 140° F. water. At this point, the temperature responsive element 68 will cause the valve 66 to open by-passing the valve 62 so as to allow the heated water to flow to the bottom of the tank via conduits 48, 40 and 39. Simultaneously, the valve 62 will become closed due to the lower condensing temperature of about 82° F. which provides the temperature of the water in the return passage 36 to be approximately 74° F. This lower condensing temperature is due to the unrestricted flow path permitted in opening of the valve 66, which greatly increases the coefficient of performance and heating capacity of the refrigerant system. As a result, the energy requirement and operating cost for heating hot water is sufficiently reduced.

The heated water in the lower two-thirds of the tank is continually circulated by the pump 32 to reheat the water at the outlet 50 until the water in the lower two-thirds is also at 140° F. Once the lower two-thirds is completely filled with 140° F. water, the compressor 10, the electric motor 21 and pump 32 will become shut-off. When water is drawn off the supply line 44, a corresponding amount of cold make-up water from line 46 enters the bottom of the tank via the inlet 39 and is circulated by the pump through the coil 28 for heating, thereby insuring efficient operation of the refrigerant system.

When there is a demand for hot water in the supply line 44, hot water from the coil is passed through the valve 62, the discharge line 42 and directly to the supply line 44 as long as the temperature of the water is at or above the previously mentioned pre-selected temperature. If the hot water is withdrawn from the tank at a sufficient rate, hot water may be supplied from both the coil 28 and the storage tank simultaneously. On the other hand, the hot water will be supplied only from the tank when the valve 62 is closed.

Alternately, a three-way solenoid valve can be substituted for valve 66. Two connections would be made with line 36 and a third connection would be with line 48. When the valve is not energized, flow is through line 36 from the coil 28 to valve 62. When the valve is energized, water flow bypasses valve 62 and connects the line 36 to the line 48.

From the foregoing detailed description it can thus be seen that the present invention provides a new and improved refrigerant condensing system which is connectable to a conventional water heater storage tank for heating the water thereof. Further, the refrigerant condensing system includes a by-pass valve for allowing the heated water from the condenser to flow to the bottom of the water tank after the upper one-third of the tank has been filled with 140° F. water, thereby increasing its efficiency and heating capacity.

While there has been illustrated and described what is at present to be a preferred embodiment of the present invention, it will be understood by those skilled in the art that various changes and modifications may be made and equivalents may be substituted for elements thereof without departing from the true scope of the invention. In addition, many modifications may be made to adapt a particular situation on material to the teachings of the invention without departing from the central scope thereof. Therefore, it is intended that this invention not be limited to the particular embodiment disclosed as the best mode contemplated for carrying out this invention but that the invention will include all embodiments falling in the scope of the appended claims.

What is claimed is:

1. A refrigerant condensing system for heating water including a compressor, a water-cooled condenser, an expansion device, and an evaporator coil, all suitably interconnected to form a closed refrigeration circuit, said system comprising in combination:

said condenser having a chamber with a coil disposed therein in heat exchange relationship, the coil having a water inlet and a water outlet;

a storage tank having a substantially unbaffled interior chamber, a high temperature inlet connected to its upper part, a lower temperature inlet connected to its bottom part, a hot water supply line, and an outlet;

pump means for circulating the water to be heated from the storage tank to the water inlet of the coil;

thermostatically-operated valve means operatively connected to the water outlet of the coil for permitting water to flow into the upper part of the tank in response to a pre-selected temperature, said valve means being operative to prevent unrestricted flow of water until the temperature of such water is at or above a predetermined temperature; and by-pass valve means operatively connected to the water outlet of the coil for by-passing directly the water flow from the high temperature inlet of the tank to the lower temperature inlet when the upper portion of the tank is filled with water of the pre-selected temperature.

2. A refrigerant condensing system as claimed in claim 1, wherein said thermostatically-operated valve means comprises a normally closed valve which opens when the temperature of the water in the water outlet of the coil exceeds the pre-selected temperature.

3. A refrigerant condensing system as claimed in claim 1, wherein said by-pass valve means comprises an electrically-operated valve which opens when the temperature of the water in the upper portion of the tank rises above the pre-selected temperature.

4. A refrigerant condensing system as claimed in claim 1, further comprising a temperature-sensitive switch having contacts which close upon the temperature of the water in the lower portion of the tank falling below a second pre-selected temperature, said switch activating said compressor and said pump means in response to the pre-selected temperature.

5. A refrigerant condensing system as claimed in claim 1, wherein said circulating means comprises a pump.

6. A refrigerant condensing system as claimed in claim 2, wherein said thermostatically-operated valve includes a thermostatic element disposed on said water outlet of the coil for sensing the temperature of the water.

7. A refrigerant condensing system as claimed in claim 3, wherein said by-pass valve includes a thermostatic element disposed operatively within the tank at a point substantially one-third from the top for sensing the temperature of the water therein.

* * * * *

UNITED STATES PATENT AND TRADEMARK OFFICE

CERTIFICATE OF CORRECTION

PATENT NO. : 4,314,456

DATED : February 9, 1982

INVENTOR(S) : JAMES R. HARNISH

It is certified that error appears in the above—identified patent and that said Letters Patent is hereby corrected as shown below:

Column 6, lines 29 to 31, cancel "directly the water flow from the high temperature inlet of the tank".

Column 6, lines 29 to 31 after "by-passing" insert -- the thermostatically operated valve means and allowing unrestricted flow of water --.

Signed and Sealed this

*Twenty-seventh* Day of *April 1982*

[SEAL]

*Attest:*

GERALD J. MOSSINGHOFF

*Attesting Officer*

*Commissioner of Patents and Trademarks*